United States Patent [19]

Maenaka

[11] Patent Number: 4,911,208

[45] Date of Patent: Mar. 27, 1990

[54] WEFT YARN MEASURING METHOD FOR A PICKING DEVICE

[75] Inventor: Koyu Maenaka, Ishikawa, Japan

[73] Assignee: Tsudakoma Corp., Ishikawa, Japan

[21] Appl. No.: 262,876

[22] Filed: Oct. 26, 1988

[30] Foreign Application Priority Data

Oct. 30, 1987 [JP] Japan ..... 62-275074

[51] Int. Cl.[4] ..... D03D 47/36

[52] U.S. Cl. ..... 139/435 R; 139/452

[58] Field of Search ..... 139/452, 435; 242/47.01

[56] References Cited

U.S. PATENT DOCUMENTS 4,756,344 6/1988 Takeagawa ..... 139/452
4,768,565 9/1988 Tholander ..... 139/452

FOREIGN PATENT DOCUMENTS 57-29640 2/1982 Japan .
59-204947 11/1984 Japan .
61-215745 9/1986 Japan .
61-164288 10/1986 Japan .

*Primary Examiner*—Henry S. Jaudon
*Attorney, Agent, or Firm*—Wenderoth, Lind & Ponack

[57] ABSTRACT

A weft yarn measuring method controls the picking device of a fluid jet loom so as to pick a weft yarn of a predetermined length in each picking cycle. In releasing loops of the weft yarn wound on the storage drum of the picking device, the retaining pin of the picking device is controlled so that only one of the loops of the weft yarn is unwound at each reciprocation of the retaining pin, and the reciprocation of the retaining pin is repeated a plurality of times to unwind accurately a plurality of loops of the weft yarn corresponding to a predetermined length of the weft yarn necessary for one picking cycle.

17 Claims, 3 Drawing Sheets

WEFT YARN MEASURING METHOD FOR A PICKING DEVICE

BACKGROUND OF THE INVENTION

1. Field of the Invention:

The present invention relates to a picking device for a fluid jet loom and, more particularly, to a weft yarn measuring method which enables the accurate measurement of a weft yarn of a necessary length.

2. Description of the Prior Art:

A drum type weft yarn measuring and storing device measures a weft yarn of a necessary length by winding the weft yarn on a stationary storage drum with a rotary yarn guide while a retaining pin retains the weft yarn on the storage drum. At a picking phase, the retaining pin is retracted from the circumference of the storage drum to release the weft yarn wound on the storage drum, and then the weft yarn is picked into a shed by a jet of fluid jetted by a picking nozzle.

In measuring the weft yarn, the length of yarn unwound on the storage drum is determined by the number of loops of the weft yarn on the storage drum. Japanese Laid-Open Patent Publication No. 57-29640 discloses an invention for unwinding the weft yarn of a length necessary for one picking cycle, in which the number of loops of the weft yarn unwound from a storage drum is counted by a photoelectric sensor disposed near the circumference of the storage drum. It is possible that such a photoelectric counting means fail to detect the quick passage of a thin weft yarn across a counting position and that the photoelectric counting means fails to count the number of loops accurately because fly and dust are liable to be deposited on the light receiving surface of the photoelectric counting means.

On the other hand, a device disclosed in Japanese Laid-Open Utility Model Publication No. 61-164288 releases a plurality of loops of a weft yarn necessary for one picking cycle from a storage drum by controlling the duration of retraction of a retaining pin. This device, however, is unable to release the predetermined plurality of loops of the weft yarn accurately, because the running mode of the picked weft yarn with respect to a time axis is variable due to variations in the physical properties of the weft yarn and variations in the pressure of the picking fluid. That is, although the retaining pin is retracted for a predetermined period of time, the running speed of the picked weft yarn is caused to vary by the variations of the physical properties of the weft yarn and the variations of the pressure of the picking fluid and, consequently, the number of loops of the weft yarn unwound in the predetermined period of time during which the retaining pin is held at the retracted position varies. The greater the number of loops of the weft yarn necessary for one picking cycle, the greater is error in the measurement.

SUMMARY OF THE INVENTION

Accordingly, it is an object of the present invention to provide a weft yarn measuring method by which an accurate number of loops of a weft yarn can be unwound from a storage drum in feeding the weft yarn for a picking operation.

To achieve the object of the invention, the present invention provides a weft yarn measuring method in which a single loop of the weft yarn wound on a storage drum is unwound every time a retaining pin is retracted instead of unwinding a plurality of loops of the weft yarn every time the retaining pin is retracted, and the retraction and advancement of the retaining pin is repeated several times for one picking cycle to unwind a necessary length of the weft yarn accurately from the storage drum for each picking cycle.

Thus, the loops of the weft yarn are unwound from the storage drum one at a time and, consequently, the loops of the weft yarn are retained by the retaining pin before the loops of the weft yarn are affected by the large variations of the running characteristics of the picked weft yarn. Thus, the predetermined number of loops of the weft yarn are unwound accurately.

According to the present invention, a predetermined number of loops of the weft yarn are unwound by repeating the retraction and advancement of the retaining for each picking cycle, and the weft yarn wound on the storage drum is retained with the retaining pin before the weft yarn wound on the storage drum is affected by the large variations of the running characteristics and variations in the physical properties of the picked weft yarn. Therefore, the method of the present invention reduces error in the measurement of the weft yarn more effectively than the conventional method by which a plurality of loops of the weft yarn is unwound from the storage drum in one cycle of retraction and advancement of the retaining pin.

The above and other objects, features and advantages of the present invention will become more apparent from the following description taken in conjunction with the accompanying drawings.

DETAILED DESCRIPTION OF THE PREFERRED EMBODIMENT

Figure 1:
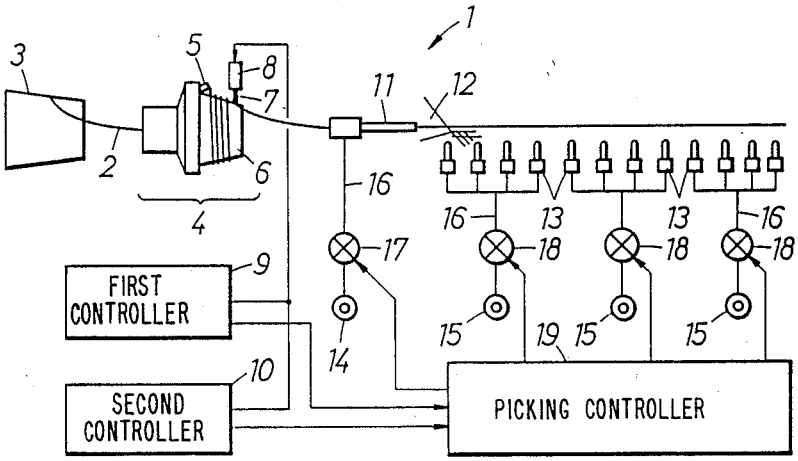
FIG. 1 is a block diagram of a picking device for carrying out a weft yarn measuring method in accordance with a first embodiment of the present invention.

Referring to FIG. 1 showing a picking device 1 for carrying out a weft yarn measuring method in accordance with a first embodiment of the present invention, a weft yarn 2 unwound from a yarn package 3 is wound by the rotary motion of a rotary yarn guide 5 on a stationary storage drum 6 while the free end of the weft yarn 2 is held on the circumference of the storage drum 6 with a retaining pin 7. The retaining pin 7 is operated for advancement and retraction by an operating unit 8. The operating unit 8 is controlled by a first controller 9 during the high-speed operation of the loom and is controlled by a second controller 10 on the basis of a weft yarn measuring method of the present invention during the low-speed operation of the loom.

The operating unit 8 retracts the retaining pin 7 from the circumference of the storage drum 6 in synchronism with a picking operation to release the loops of the weft yarn 2 from the circumference of the storage drum 6, a picking nozzle 11 jets a fluid to pick the weft yarn 2 into a shed 12, and then a plurality of subnozzles 13 assist the picked weft yarn 2 in running through the shed 12. The picking nozzle 11 and the subnozzles 13 are connected to fluid sources 14 and 15 storing pressurized fluid through piping 16 and control valves 17 and 18, respectively. The control valves 17 and 18 are controlled by a picking controller 19 in synchronism with the operation of the loom.

While the loom is operated at a low speed for gaiting the loom or in correcting mispicks, the second controller 10 controls the operating unit 8 in accordance with the weft yarn measuring method of the present invention to release a plurality of loops of the weft yarn at a time from the storage drum 6 so that the weft yarn 2 of a length necessary for one picking cycle is picked.

That is, upon the reception of a weft yarn release command from the main controller of the loom, the second controller 10 executes one control routine to make the operating unit 8 retract the retaining pin 7 from the circumference of the storage drum 6 to release the weft yarn 2 from the storage drum 6 and to make the operating unit 8 advance the retaining pin 7 to the circumference of the storage drum 6 before a time period necessary for releasing one loop of the weft yarn 2 elapses after the retraction of the retaining pin 7 so that only one loop of the weft yarn 2 is unwound from the storage drum 6. On the other hand, the picking controller 19 controls the control valves 17 and 18 to jet the fluid continuously from the picking nozzle 11 and the subnozzles 13 at a pressure lower than the normal pressure for the normal picking operation to insert the weft yarn 2 of a length corresponding to one loop on the storage drum 6 in the shed 12. Thus, the weft yarn 2 of a length corresponding to one loop on the storage drum 6 is inserted at each reciprocation of the retaining pin 7.

Suppose that the length of the weft yarn 2 necessary for one picking cycle corresponds to four loops. Then, the second controller 10 repeats the control routine three more times so that the weft yarn 2 of a length corresponding to four loops on the storage drum 6 is released accurately from the storage drum 6 for one picking cycle.

Thus, according to the present invention, one loop of the weft yarn 2 is unwound from the storage drum 6 at each reciprocation of the retaining pin 7 and the reciprocation of the retaining pin 7 is repeated the required number of times. Accordingly, the measurement of the necessary length of the weft yarn 2 released from the storage drum 6 is hardly affected by variations in the physical properties of the weft yarn 2 and variations in the picking conditions, so that accurate measurement of the necessary length of the weft yarn is achieved.

FIRST EMBODIMENT (FIGS. 2 AND 3)

In the first embodiment, the second controller 10 repeats the control routine continuously in response to one weft yarn release command.

Figure 2:
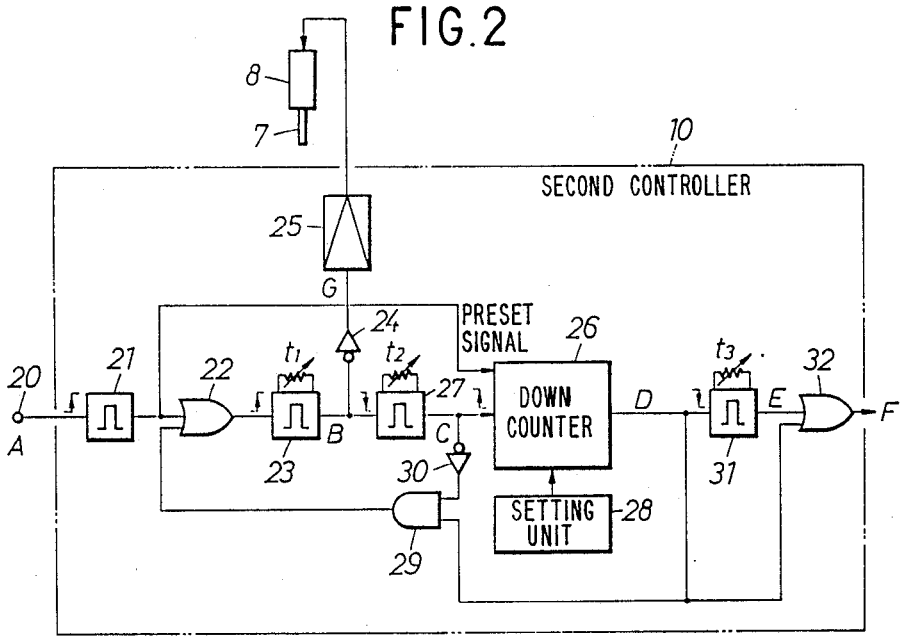
FIG. 2 is a block diagram of a controller incorporated into the picking device of FIG. 1.
Figure 3:
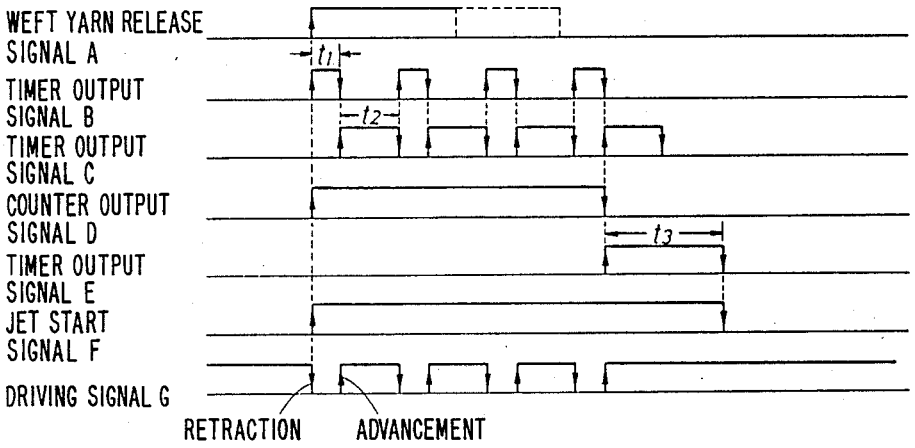
FIG. 3 is a time chart of assistance in explaining the operation of the picking device of FIG. 1.

Referring to FIG. 2, when a release signal A of a HIGH level is supplied to an input terminal 20, a one-shot multivibrator 21 generates a pulse at a leading edge, sets a down counter 26, and starts a timer 23 through an OR circuit 22. Then, the timer 23 generates a timer output signal B of a HIGH level for a time period $t_1$ as shown in FIG. 3. A NOT circuit 24 converts the timer output signal B into a driving signal G of a LOW level, an amplifier 25 amplifies the driving signal G, and then the amplified driving signal G is supplied to the operating unit 8 to make the operating unit 8 retract the retaining pin 7. A timer 27 provided after the timer 23 generates a timer output signal C of a HIGH level for a time period $t_2$ after the timer output signal B has fallen to decrement the count of the down counter 26 by one. Thus, the retaining pin 7 is retracted for the time period $t_1$ and then the retaining pin 7 is held at the retaining position for the time $t_2$ to unwind one loop of the weft yarn 2 from the storage drum 6 while the retaining pin 7 is retracted. A setting unit 28 for setting the length of the weft yarn necessary for one picking cycle is set beforehand for the number of loops corresponding to the necessary length of the weft yarn 2. A counter output signal D remains at a HIGH level until the count of the down counter 26 reaches zero. An AND circuit 29 generates an output signal of a HIGH level when the counter output signal D is a HIGH level, and the output signal of a HIGH level of a NOT circuit 30 which receives the timer output signal C are supplied thereto. Therefore, the AND circuit 29 generates an output signal of a HIGH level to start the timer 23 again when the timer output signal C becomes a LOW level. Thus, four cycles of the weft yarn releasing operation is executed successively to release four loops of the weft yarn 2 from the storage drum 6. The time $t_2$ is determined so that one loop of the weft yarn 2 is released completely during a time period of $t_1+t_2$.

While the output signal D of the down counter 26 is at a HIGH level, an OR circuit 32 applies a jet start signal F of a HIGH level to the picking controller 19 to make the picking nozzle 11 and the subnozzles 13 jet the fluid continuously. A timer output signal E of a HIGH level is generated countinuously for a time $t_3$ after the counter output signal D has changed to a LOW level, and hence the picking nozzle 11 and the subnozzles 13 continue jetting the fluid for the time period $t_3$.

Thus, upon the reception of the weft yarn release signal A of a HIGH level, the second controller 10 reciprocates the retaining pin 7 by a number of reciprocations corresponding to the number of loops corresponding to the length of the weft yarn 2 necessary for one picking cycle the loops of the weft yarn 2 are unwound intermittently one at a time from the storage drum 6.

SECOND EMBODIMENT (FIGS. 4 AND 5)

The first embodiment determines timing of the next weft yarn releasing operation by the timer 27, while the second embodiment determines timing of the next weft yarn releasing operation by detecting a shock of engagement of the retaining pin 7 with the weft yarn 2 after one loop of the weft yarn 2 has been released.

Figure 4:
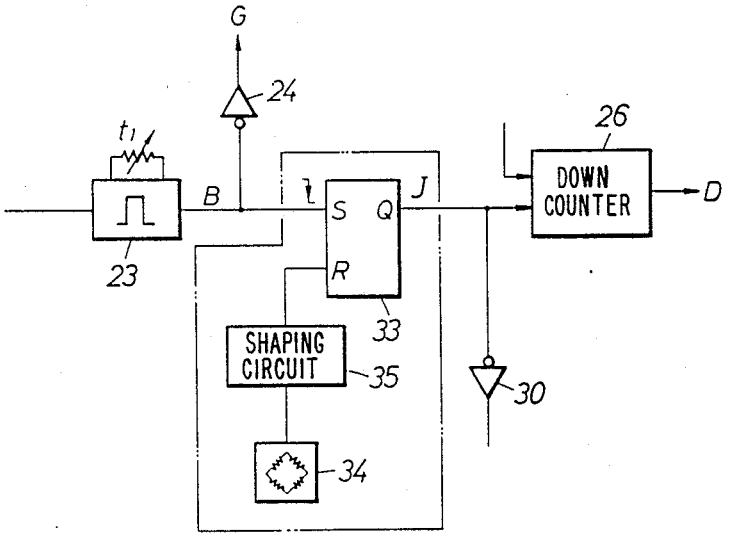
FIG. 4 is a block diagram of a controller incorporated into a picking device for carrying out a weft yarn measuring method in accordance with a second embodiment of the present invention.

In the second embodiment, a flip-flop 33 is provided instead of the timer 27 between the timer 23 and the down counter 26 as shown in FIG. 4. A strain gauge 34 attached to the retaining pin 7 is connected through a shaping circuit 35 to the reset input terminal of the flip-flop 33.

Figure 5:
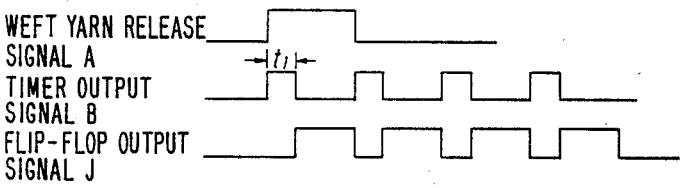
FIG. 5 is a time chart of assistance in explaining the operation of the picking device for carrying out the weft yarn measuring method in according with the second embodiment of the present invention.
Figure 6:
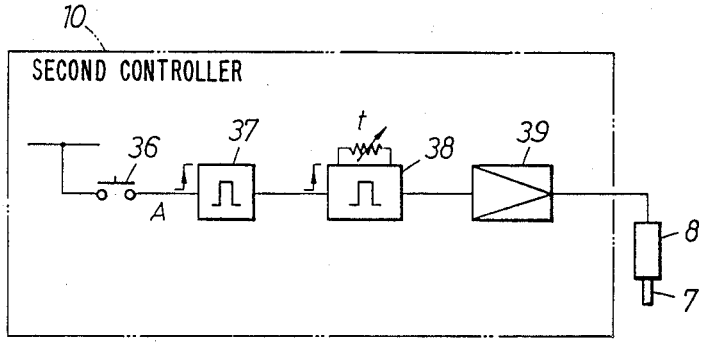
FIG. 6 is a block diagram of a controller incorporated into a picking device for carrying out a weft yarn measuring method in according with a third embodiment of the present invention.

The timer 23 generates a timer output signal B of a HIGH level for a time period $t_1$ after the weft yarn release signal A of a HIGH level has been supplied to the second controller 10 as shown in FIG. 5 to set the flip-flop 33, so that the flip-flop 33 generates a flip-flop output signal J of a HIGH level. When the retracted retaining pin 7 is advanced, and engages the weft yarn 2 being unwound, an external force acts on the strain gauge 34, and then the strain gauge 34 generates an output signal to reset the flip-flop 33. Thus, loops of the weft yarn 2 corresponding to a length of the weft yarn 2 necessary for one picking cycle are unwound automatically.

THIRD EMBODIMENT (FIG. 6)

In the third embodiment, the retaining pin 7 is retracted and advanced manually.

An operator closes a weft yarn release switch 36 to provide the weft yarn release signal A. Then, a one-shot multivibrator 37 is actuated to retract the retaining pin for a time period t determined by a timer 38, and one loop of the weft yarn 2 is thereby unwound surely from the storage drum 6. For a picking operation during the gaiting of the loom, the loom is stopped in a picking phase where the shed is formed for the picking operation and the control valves 17 and 18 are opened simultaneously to jet the fluid continuously from the picking nozzle 11 and the subnozzles 13. Then the operator pushes the push-button of the weft yarn release switch 36 a number of times corresponding to the number of loops corresponding to the length of the weft yarn 2 necessary for one picking cycle to insert the weft yarn 2 in the shed. Then, the operator makes the main shaft of the loom rotate one full turn to form a new shed 12 for the next picking operation, and then repeats the same picking procedure.

MODIFICATION

Although the present invention has been described as applied to the measurement of the weft yarn while the loom is operating at a low operating speed, the present invention is also applicable to the measurement of the weft yarn in a transient operating state subsequent to the start of the loom and to the normal high-speed operation of the loom.

Although the invention has been described in its preferred form with a certin degree of particularity, it is to be understood that many variations and changes are possible in the invention without departing from the scope thereof.

What is claimed is:

1. A weft yarn measuring method for a picking device which winds a weft yarn in loops around a stationary storage drum by the rotary motion of a rotary yarn guide while the free end of the weft yarn is held on the circumference of the storage drum with a retaining pin, retracts the retaining pin to release the loops of the weft yarn from the storage drum, and picks the released weft yarn into a shed by a picking nozzle by means of a jet of fluid, wherein the retaining pin is retracted from the circumference of the storage drum to release the weft yarn from the storage drum, the retaining pin is advanced to the circumference of the storage drum before a time necessary for unwinding one loop of the weft yarn from the storage drum elapses after the retaining pin has been retracted from the storage drum to unwind only one loop of the weft yarn from the storage drum, the weft yarn releasing procedure is repeated a plurality of times to unwind the loops of the weft yarn corresponding to a length of the weft yarn necessary for one picking cycle.

2. A weft yarn measuring method according to claim 1, wherein timing of retraction of the retaining pin and timing of advancement of the retaining pin are controlled by timer output signals.

3. A weft yarn measuring method according to claim 2, wherein the frequency of reciprocation for retraction and advancement of the retaining pin is counted by a down counter, and the reciprocation of the retaining pin is stopped when the counter output signal is provided upon the arrival of the count of the down counter at zero.

4. A weft yarn measuring method according to claim 3, wherein a command to start releasing the weft yarn from the storage drum is provided by a weft yarn relesed command signal provided by the main controller of the loom, 5. A weft yarn measuring method according to claim 2, wherein a command to start releasing the weft yarn from the storage drum is provided by a weft yarn relesed command signal provided by the main controller of the loom.

6. A weft yarn measuring method according to claim 2, wherein a command to start releasing the weft yarn from the storage drum is provided by a manual operation of a weft yarn releasing switch by an operator.

7. A weft yarn measuring method according to claim 1, wherein the number of reciprocations for retraction and advancement of the retaining pin is counted by a down counter, and the reciprocation of the retaining pin is stopped when the counter output signal is provided upon the arrival of the count of the down counter at zero.

8. A weft yarn measuring method according to claim 7, wherein a command to start releasing the weft yarn from the storage drum is provided by a weft yarn relesed command signal provided by the main controller of the loom.

9. A weft yarn measuring method according to claim 7, wherein a command to start releasing the weft yarn from the storage drum is provided by a manual operation of a weft yarn releasing switch by an operator.

10. A weft yarn measuring method according to claim 1, wherein the completion of operation for unwinding one loop of the weft yarn is detected by a signal generated upon the engagement of the retaining pin with the weft yarn.

11. A weft yarn measuring method according to claim 10, wherein a command to start releasing the weft yarn from the storage drum is provided by a weft yarn relesed command signal provided by the main controller of the loom.

12. A weft yarn measuring method according to claim 10, wherein a command to start releasing the weft yarn from the storage drum is provided by a manual operation of a weft yarn releasing switch by an operator.

13. A weft yarn measuring method according to claim 1, wherein the second weft yarn releasing operation and the subsequent weft yarn releasing operation is started at a moment detected by the signal generated upon the engagement of the retaining pin with the weft yarn.

14. A weft yarn measuring method according to claim 13, wherein a command to start releasing the weft yarn from the storage drum is provided by a weft yarn relesed command signal provided by the main controller of the loom.

15. A weft yarn measuring method according to claim 13, wherein a command to start releasing the weft yarn from the storage drum is provided by a manual operation of a weft yarn releasing switch by an operator.

16. A weft yarn measuring method according to claim 1, wherein a command to start releasing the weft yarn from the storage drum is provided by a weft yarn released command signal provided by the main controller of the loom.

17. A weft yarn measuring method according to claim 1, wherein a command to start releasing the weft yarn from the storage drum is provided by a manual operation of a weft yarn releasing switch by an operator.

* * * * *